US007706960B2

(12) United States Patent
Nishida et al.

(10) Patent No.: US 7,706,960 B2
(45) Date of Patent: Apr. 27, 2010

(54) CAPACITOR-DISCHARGE IGNITION SYSTEM FOR INTERNAL COMBUSTION ENGINE

(75) Inventors: Kazutomo Nishida, Saitama (JP); Mitsuyoshi Kanai, Saitama (JP); Kentaro Taniguchi, Saitama (JP); Akihito Kasai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 50 days.

(21) Appl. No.: 12/082,015

(22) Filed: Apr. 8, 2008

(65) Prior Publication Data

US 2008/0257322 A1 Oct. 23, 2008

(30) Foreign Application Priority Data

Apr. 23, 2007 (JP) ..... 2007-113393

(51) Int. Cl.
*F02P 5/15* (2006.01)
*F02P 3/06* (2006.01)

(52) U.S. Cl. ..... 701/112; 123/406.57; 123/605; 123/650

(58) Field of Classification Search ..... 123/406.57, 123/605, 618, 621, 650, 596, 600; 701/112
See application file for complete search history.

(56) References Cited

U.S. PATENT DOCUMENTS 6,973,911 B2 * 12/2005 Yamashita ..... 123/335
2006/0163879 A1 * 7/2006 Sekita et al. ..... 290/41

FOREIGN PATENT DOCUMENTS

JP 06-006229 1/1994
JP 11-44281 * 2/1999

* cited by examiner

*Primary Examiner*—Hai H Huynh
(74) *Attorney, Agent, or Firm*—Carrier, Blackman & Associates P.C.; Joseph P. Carrier; William D. Blackman

(57) ABSTRACT

In a capacitor-discharge ignition system for an internal combustion engine having a power generation coil, a capacitor connected to the power generation coil, an ignition coil having a primary winding connected to the capacitor through a thyristor and a secondary winding connected to a spark plug, and a microprocessor which turns on the thyristor at a predetermined crank angular position to produce ignition in the spark plug, an engine stop switch is installed to input an engine-stop command signal to the microprocessor when being turned off by the operator. With this, it becomes possible to surely stop the engine at any time if desired.

10 Claims, 2 Drawing Sheets

CAPACITOR-DISCHARGE IGNITION SYSTEM FOR INTERNAL COMBUSTION ENGINE

CROSS REFERENCE TO RELATED APPLICATIONS

The present application claims priority under 35 USC 119 based on Japanese Patent Application JP2007-113393 filed on Apr. 23, 2007, the entire contents of the priority document is incorporated herein by reference.

BACKGROUND OF THE INVENTION

1. Field of the Invention

This invention relates to a capacitor-discharge ignition (CDI) system for an internal combustion engine, more particularly to the CDI system for an engine that can surely stop the engine at any time if needed.

2. Description of the Related Art

The CDI system for an internal combustion engine generally includes a power generation coil which is fixed on the engine body inside a rotating flywheel to generate electric power when crossing the fluxes of magnets fastened on the inner wall of the rotating flywheel, and a capacitor which stores the electric power produced by the power generation coil. When a switching element such as thyristor is turned on, the charge stored in the capacitor is discharged to the primary winding of an ignition coil through the switching element so as to produce high voltage for ignition in the secondary winding, as taught, for example, in Japanese Utility Model Publication No. Hei 6 (1994)-6229.

In the ignition system, an engine stop switch is installed to be manipulated by an operator. When the stop switch is turned on by the operator, the power generation coil or primary ignition coil is grounded or short-circuited such that the engine is stopped. However, if wire breakage occurs in the switch circuit, it becomes impossible to stop the engine.

SUMMARY OF THE INVENTION

An object of this invention is therefore to overcome this problem by providing a capacitor-discharge ignition (CDI) system for an internal combustion engine that can surely stop the engine at any time if desired in response to the operator's manipulation of an engine stop switch.

In order to achieve the object, this invention provides a capacitor-discharge ignition system for an internal combustion engine having a power generation coil attached to the engine to generate an alternating current output, comprising: a capacitor connected to the power generation coil to be charged by the output of the power generation coil; an ignition coil having a primary winding connected to the capacitor through a current supply path and a secondary winding connected to a spark plug; a switching element installed in the current supply path; a microprocessor adapted to turn on the switching element at a predetermined crank angular position to cause the capacitor to discharge the stored charge to the primary winding so as to produce ignition in the spark plug to ignite air-fuel mixture in a combustion chamber of the engine; an engine stop switch installed at a location where an operator can manually manipulate the switch and connected to the microprocessor, the switch inputting an engine-stop command signal to the microprocessor when being actuated by the operator; and the microprocessor turns off the switching element to discontinue the ignition to stop the engine when the signal is inputted.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments of the invention will now be explained by way of example only and with reference to the attached drawings.

Figure 1:
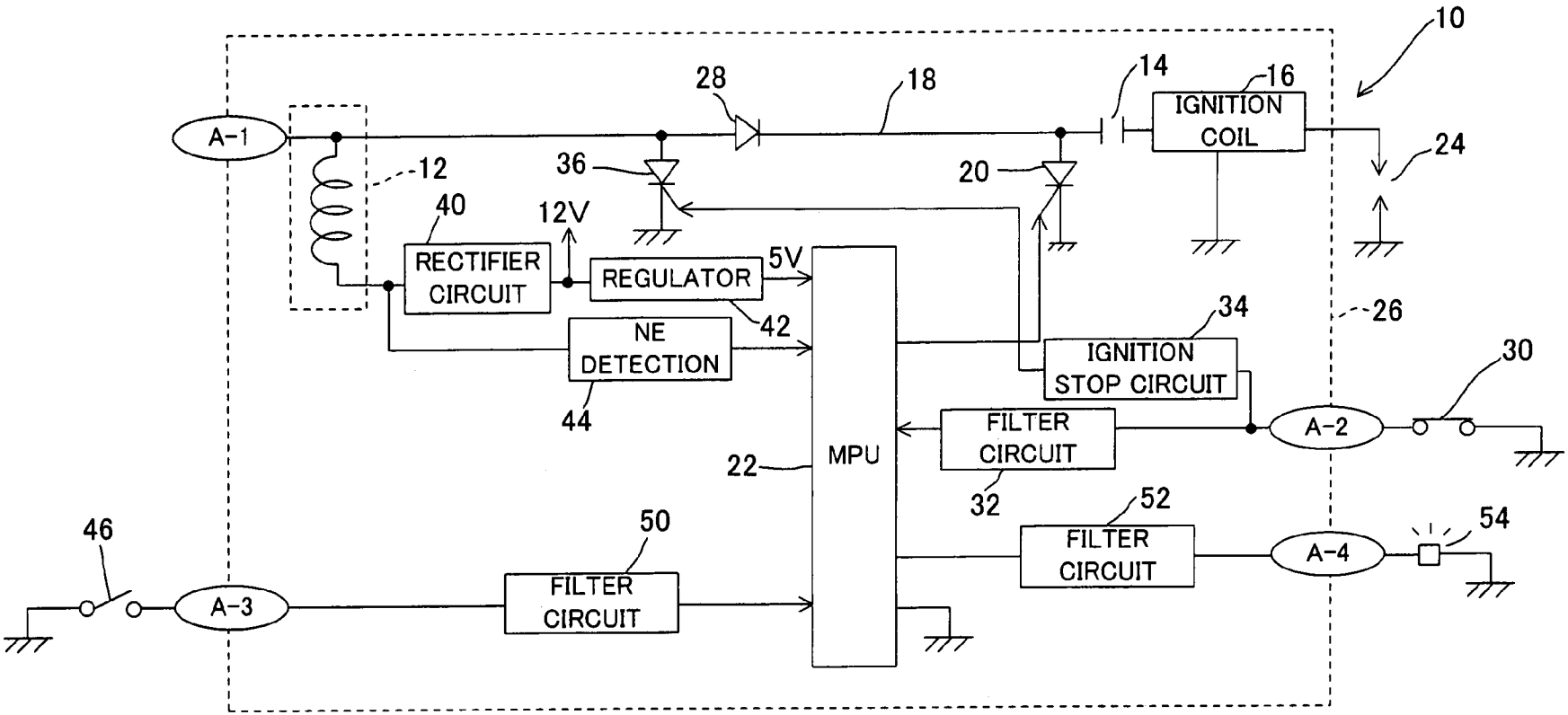
FIG. 1 is a diagram of an overall capacitor-discharge ignition system for an internal combustion engine according to a first embodiment of the invention.

FIG. 1 is a diagram of the overall capacitor-discharge ignition system for an internal combustion engine according to the first embodiment of the invention.

Reference numeral 10 in FIG. 1 designates a capacitor-discharge ignition (CDI) system for an internal combustion engine. The engine is an air-cooled, four-cycle, single-cylinder OHV model with a displacement of, for example, 390 cc. The engine 10 is suitable for use as the prime mover of electric generators, agricultural machines or any of various other kinds of equipment.

As illustrated in the figure, the system 10 comprises at least a capacitor 14 that stores an alternating current output produced by an exciter coil (power generation coil) 12, an ignition coil 16 having a primary winding (not shown) connected to the capacitor 14 through a current supply path 18 and a secondary winding (not shown), a first thyristor (switching element) 20 installed in the current supply path 18 from the exciter coil 12 to the primary winding, a microprocessor (or microprocessing unit; MPU) 22 adapted to turn on the thyristor 20 at a predetermined crank angular position so as to discharge the electric energy stored in the capacitor 14 to the primary coil of the ignition coil 16, and a spark plug 24 that produces a spark between electrodes when a high voltage is generated in the secondary winding (not shown) in response to the termination of discharge to the primary winding of the ignition coil 16.

Most of these elements of the system 10 mentioned above are housed in an electronic control unit 26. In FIG. 1, A-n (n: 1 to 4) in the figure indicates terminals.

A flywheel (not shown) is connected to the crankshaft (not shown) of the engine to rotate therewith and a plurality of magnet pieces are attached to the inner surface of the flywheel. The exciter coil 12 is fixed to the engine body at a location inside the flywheel and constitutes a multi-polar generator together with the magnet pieces that produces alternating current in synchronism with crankshaft rotation. The alternating current generated by the exciter coil 12 is half-wave rectified by a diode 28 and charges the capacitor 14.

The thyristor 20 is connected to the current supply path 18 from the exciter coil 12 to the primary winding of the ignition coil 16, with its anode terminal connected to the current supply path 18 and with its cathode terminal grounded. The gate terminal of the thyristor 20 is connected to the microprocessor 22.

When the microprocessor 22 supplies the gate current to the gate terminal, the thyristor 20 is turned on, i.e. conducts such that the electric charge of the capacitor 14 is discharged to the primary winding of the ignition coil 16. High electric voltage produced in the secondary winding of the ignition coil 16 in response to the termination of discharge to the primary winding generates a spark between the electrodes of the spark plug 24, to ignite the air-fuel mixture in a combustion chamber (not shown) of the engine.

In this embodiment, the system 10 is installed on the engine at a location near an engine cover (not shown) and an engine stop switch 30 is installed at a location where an operator (user of the engine) can easily manipulate. The engine stop switch 30 is normally kept closed, i.e., it is normally turned on, but if the switch 30 is turned off by the operator, it inputs or sends an engine-stop command signal to the microprocessor 22. The microprocessor 22 terminates the ignition to stop the engine, when the engine-stop command signal is inputted from the stop switch 30.

To be more specific, the stop switch 30 is connected to the ECU 26 through the terminal A-2 and in the ECU 26, it is connected to the microprocessor 22 through a noise-removal filter circuit 32 and is also connected to the gate terminal of a second thyristor (switching element) 36 through an ignition stop circuit 34.

The second thyristor 36 is connected to the current supply path 18 at a position upstream of the diode 28, with its anode terminal connected to the current supply path 18 and with its cathode terminal grounded in a manner similar to the first thyristor 20. The ignition stop circuit 34 comprises electric circuits independently from the microprocessor 22.

The exciter coil 12 is connected to a rectifier circuit 40 having four diodes bridged together, where the output of the exciter coil 12 is full-wave rectified and is converted into direct current at 12 V or thereabout.

The direct current is supplied to actuators (not shown) including an electric motor for driving a throttle valve in Drive-by-Wire fashion as their operating power. The direct current is also supplied to a regulator 42 where it is dropped to 5 V or thereabout to be supplied to the microprocessor 22 as its operating power.

Further, the exciter coil 12 is connected, at a position upstream of the rectifier circuit 40, to an engine speed (NE) detection circuit 44 where the engine speed NE and a predetermined crank angular position near Top Dead Center are detected from the alternating current generated by the exciter coil 12.

An oil level switch 46 is installed at a position near the bottom of the crankcase (not shown) of the engine. The oil level switch 46 is connected to the ECU 26 through the terminal A-3 and is connected to the microprocessor 22 through a noise-removal filter 50.

The microprocessor 22 is connected a Light Emitting Diode (warning lamp) 54 through a noise-removal filter 42 and the terminal A-4.

Specifically, when the level of oil in the crankcase is excessively low and does not reach the position where the oil level switch 46 is located, the switch 46 produces an ON signal and supplies it to the microprocessor 22. In response thereto, the microprocessor 22 turns on or lights the LED 54 to alert the operator.

The operation of the system 10 illustrated in FIG. 1 will be explained.

When the operator pulls the recoil starter (not shown), the engine begins to rotate and the capacitor 14 is charged by the output of the exciter coil 12. The microprocessor 22 supplies a gate current to the gate terminal of the thyristor 20 to turn on at a predetermined crank angular position detected from the output of the engine speed detection circuit 44, such that the charge stored in the capacitor 14 is discharged to the primary winding of the ignition coil 16 to produce a high voltage in the secondary winding to ignite the air-fuel mixture. By repeating the procedures mentioned above, the rotation of the engine increases and reaches a start speed. After that, the engine continues to run stably. The engine stop switch 30 is kept closed (turned on) during the engine operation.

Under the engine operation, if the operator turns the engine stop switch 30 off, the output of the switch 30 is inputted or sent to the microprocessor 22 through the filter circuit 32. After having confirmed that the output of the switch 30 continues for a predetermined period of time, the microprocessor 22 stops supplying the gate current to the gate terminal of the thyristor 20, thereby the discharging of the capacitor 14 is discontinued to stop ignition such that the operation of the engine is stopped.

At the same time, the output of the switch 30 is inputted to the ignition stop circuit 34. In response thereto, the ignition stop circuit 34 supplies the gate current to the gate terminal of the second thyristor 36 to turn it on. With this, the exciter coil 12 is grounded and discontinues the current supply to the capacitor 14, thereby stopping ignition to cease the operation of the engine.

As stated above, in the first embodiment, the system 10 is provided with the engine stop switch 30 installed at a location where the operator can easily manipulate which inputs or sends the engine-stop command signal to the microprocessor 22 when being turned off by the operator, and the microprocessor 22 discontinues the ignition to stop the engine when the signal is inputted. With this, it becomes possible to surely stop the engine at any time if desired, without being affected by noise, when the switch 30 is manipulated by the operator.

Further, even if wire breakage occurs in the circuit of the engine stop switch 30, this accident is the same as the off-manipulation of the switch 30. Accordingly, if the accident happens during the engine operation, the engine will be stopped at once. On the other hand, if the accident happens when the engine is out of operation, since the engine can not be started, the accident will be found immediately and the wire breakage will be repaired to restore the engine stop switch 30 to normal condition. Thus, it becomes possible to surely stop the engine at any time if desired.

Furthermore, the system 10 further includes an ignition stop circuit 34, connected to the engine stop switch 30 in parallel with the microprocessor 22, in other words constituted by an electronic circuit independent from the microprocessor 22, which discontinues the ignition so as to stop the engine when the engine-stop command signal is inputted, independently from the microprocessor 22, by supplying the gate current to the gate terminal of the second thyristor 36 to ground the exciter coil 12. With this, it becomes possible to surely stop the engine at any time if desired, even when a trouble has occurred in the microprocessor 22.

Figure 2:
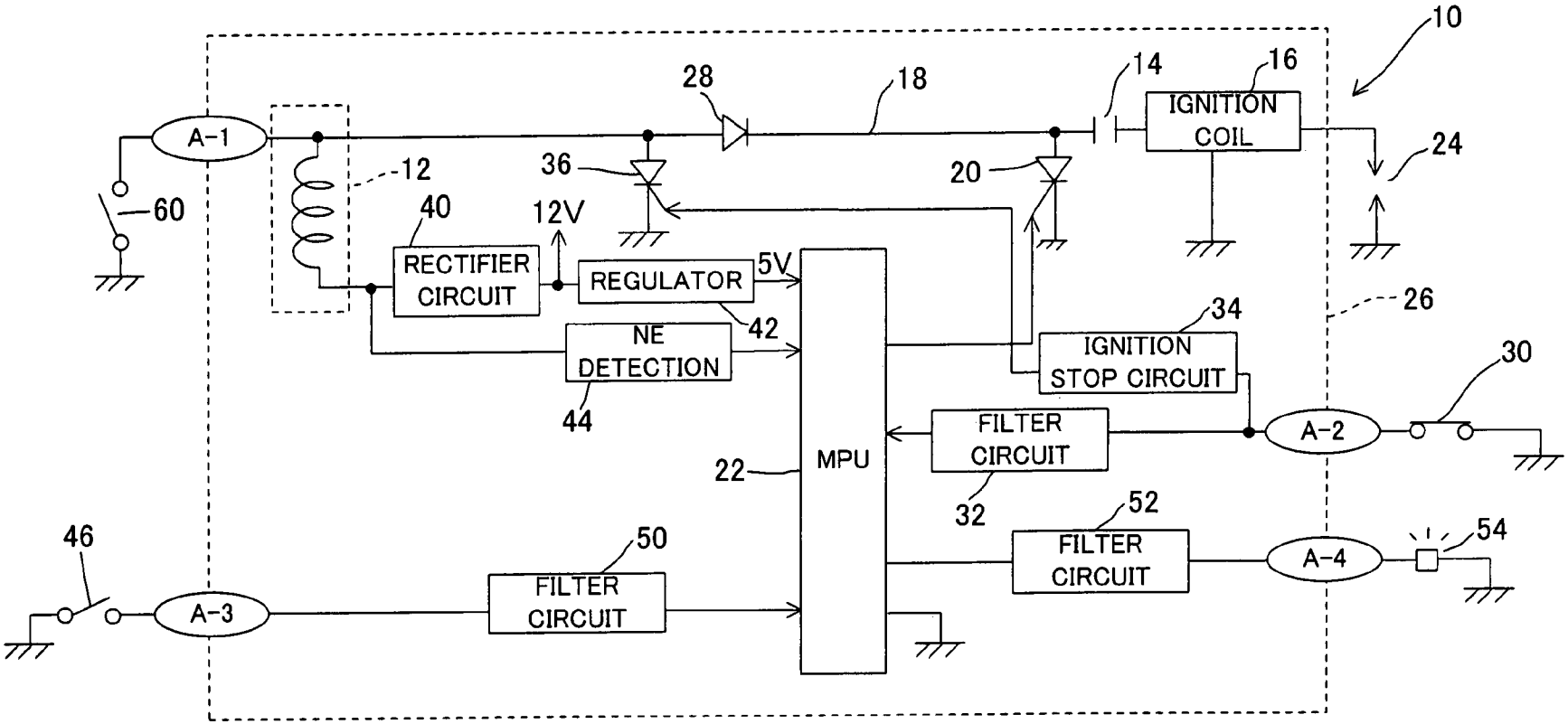
FIG. 2 is a view, similar to FIG. 1, but showing an overall capacitor-discharge ignition system for an internal combustion engine according to a second embodiment of the invention.

FIG. 2 is a view, similar to FIG. 1, but showing an overall capacitor-discharge ignition system for an internal combustion engine according to a second embodiment of the invention.

Explaining this with focus on the differences from the first embodiment, a second engine stop switch 60 is added in the second embodiment. The second engine stop switch 60 is connected to the electronic control unit 26 through the terminal A-1 and is connected to the exciter coil 12 at one end, and is grounded at the other end. Similar to the first switch 30, the second engine stop switch 60 is normally closed, i.e., is turned on.

Thus, in the second embodiment, the system 10 further includes the second engine stop switch 60, installed at a location where the operator can easily manipulate and connected to the exciter coil 12, which grounds the exciter coil 12 to stop the engine when being turned off by the operator.

With this, the engine can be stopped by either of the engine stop switches 30 or 60. Therefore, it becomes possible to more surely stop the engine at any time if desired. The rest of the configuration and other effects are the same as those of the first embodiment.

The first and second embodiments are configured to have a capacitor-discharge ignition system (10) for an internal combustion engine having a power generation coil (exciter coil) (12) attached to the engine to generate an alternating current output, comprising: a capacitor (14) connected to the power generation coil to be charged by the output of the power generation coil (12); an ignition coil (16) having a primary winding connected to the capacitor through a current supply path (18) and a secondary winding connected to a spark plug (24); a switching element (thyristor) 20 installed in the current supply path; a microprocessor (22) adapted to turn on the switching element (20) at a predetermined crank angular position to cause the capacitor (14) to discharge the stored charge to the primary winding so as to produce ignition in the spark plug (24) to ignite air-fuel mixture in a combustion chamber of the engine; an engine stop switch (30) installed at a location where an operator can easily manipulate and connected to the microprocessor (22), the switch (30) inputting an engine-stop command signal to the microprocessor (22) when being turned off by the operator; and the microprocessor (22) discontinues the ignition to stop the engine when the signal is inputted.

The system further includes an ignition stop circuit (34) connected to the engine stop switch (30) in parallel with the microprocessor (22) and discontinues the ignition to stop the engine when the signal is inputted, independently from the microprocessor (22), by supplying the gate current to the gate terminal of the second thyristor 36 so as to ground the exciter coil 12.

The second embodiment is configured to have the system further including a second engine stop switch (60) installed at a location where an operator can easily manipulate and connected to the power generation coil (12), the switch (60) grounds the power generation coil (12) to stop the engine when being turned off by the operator.

Japanese Patent Application No. 2007-113393 filed on Apr. 23, 2007, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A capacitor-discharge ignition system for an internal combustion engine having a power generation coil attached to the engine to generate an alternating current output, comprising:

a capacitor connected to the power generation coil to be charged by the output of the power generation coil;

an ignition coil having a primary winding connected to the capacitor through a current supply path and a secondary winding connected to a spark plug;

a switching element connected to the current supply path;

a microprocessor which turns on the switching element at a predetermined crank angular position to cause the capacitor to discharge the stored charge to the primary winding so as to produce ignition in the spark plug to ignite air-fuel mixture in a combustion chamber of the engine;

an engine stop switch installed at a location where an operator can manually manipulate the switch, and connected to the microprocessor, the switch inputting an engine-stop command signal to the microprocessor when being actuated by the operator, and the microprocessor turns off the switching element to discontinue the ignition to stop the engine when the signal is inputted.

2. The system according to claim 1, further including:

an ignition stop circuit connected to the engine stop switch in parallel with the microprocessor, the engine stop circuit also receives the engine-stop command signal from the engine stop switch and grounds the power generation coil to discontinue the ignition and stop the engine when the signal is inputted from the engine stop switch, independently from the microprocessor.

3. The system according to claim 2, further including:

a second engine stop switch installed at a location where an operator can manually manipulate the switch and connected to the power generation coil, the switch grounding the power generation coil to stop the engine when being actuated by the operator.

4. The system according to claim 3, wherein the second engine stop switch is normally opened.

5. The system according to claim 2, wherein the engine-stop command signal from the engine stop switch is simultaneously inputted to the microprocessor and the ignition stop circuit.

6. The system according to claim 2, further including:

a second switching element associated with the ignition stop circuit;

and the ignition stop circuit turns on the second switching element when the ignition stop circuit receives the engine-stop command signal from the engine stop switch to ground the power generation coil.

7. The system according to claim 1, further including:

a second engine stop switch installed at a location where an operator can manually manipulate the switch and connected to the power generation coil, the switch grounding the power generation coil to stop the engine when being actuated by the operator.

8. The system according to claim 7, wherein the second engine stop switch is normally opened.

9. The system according to claim 1, wherein the engine stop switch is normally closed such that the microprocessor normally supplies gate current to the switching element.

10. The system according to claim 1, wherein the switching element is a thyristor.

* * * * *